US010906710B2

(12) United States Patent
Isengingo

(10) Patent No.: US 10,906,710 B2
(45) Date of Patent: Feb. 2, 2021

(54) SELF-CLOSING LID FOR CUP

(71) Applicant: Jonathan Isengingo, Philomath, OR (US)

(72) Inventor: Jonathan Isengingo, Philomath, OR (US)

( * ) Notice: Subject to any disclaimer, the term of this patent is extended or adjusted under 35 U.S.C. 154(b) by 0 days.

(21) Appl. No.: 15/972,138

(22) Filed: May 5, 2018

(65) Prior Publication Data

US 2019/0389632 A1 Dec. 26, 2019

(51) Int. Cl.
*B65D 41/60* (2006.01)
*B65D 43/26* (2006.01)
*A47G 19/22* (2006.01)

(52) U.S. Cl.
CPC ..... *B65D 43/26* (2013.01); *A47G 19/2266* (2013.01)

(58) Field of Classification Search
CPC ..... B65D 47/286; B65D 47/26; B65D 2543/00046; A47G 19/2272; A47G 19/2266
USPC ..... 220/264, 263, 254.5, 714, 713, 711, 220/203.23, 203.19, 254.9
See application file for complete search history.

(56) References Cited

U.S. PATENT DOCUMENTS 2,154,581 A * 4/1939 Pershall ..... A47G 19/12 222/473
5,199,597 A * 4/1993 Gladish ..... A47G 19/12 220/254.9
6,098,834 A * 8/2000 Hatsumoto ..... B65D 47/249 220/212.5
6,824,003 B1 * 11/2004 Wong ..... B65D 43/0202 220/254.9
7,413,096 B2 * 8/2008 Morgan ..... A45F 3/16 220/254.9
7,753,224 B2 * 7/2010 Cai ..... B65D 47/286 220/212
8,181,810 B2 * 5/2012 Jones ..... B65D 43/0212 220/254.3
8,919,593 B2 * 12/2014 Sinacori ..... B65D 47/286 220/254.9

FOREIGN PATENT DOCUMENTS

WO WO-2007070940 A1 * 6/2007 ..... B44D 3/127

* cited by examiner

*Primary Examiner* — Joshua T Kennedy

(57) ABSTRACT

A lid for container that can be open manually but closes itself automatically, The lid can he made out of plastic, paper or metal but preferably it should be made out of plastic. Along the lid lateral side, there is an item attached firmly on the lid and acting like a spring. This spring features an extension on the end not connected to the lid that acts as a button. Additionally, for usage, the lid is manually equipped with a flexible moving piece of material that can be made out of various material but preferably out of paper. This flexible piece of material will have a cut on one end that will be used to insert the button through in such a way that after insertion, the spring, the button, and the moving tongue move simultaneously. In order to use the assembly, the user needs to exert a pressure on the button with a finger, so that the spring gets under pressure and the moving piece of material moves along the surface of the lid to reveal the opening. As soon as the pressure on the button is removed, the spring gets back to its resting position along with the moving piece of material that covers the opening once again.

1 Claim, 18 Drawing Sheets

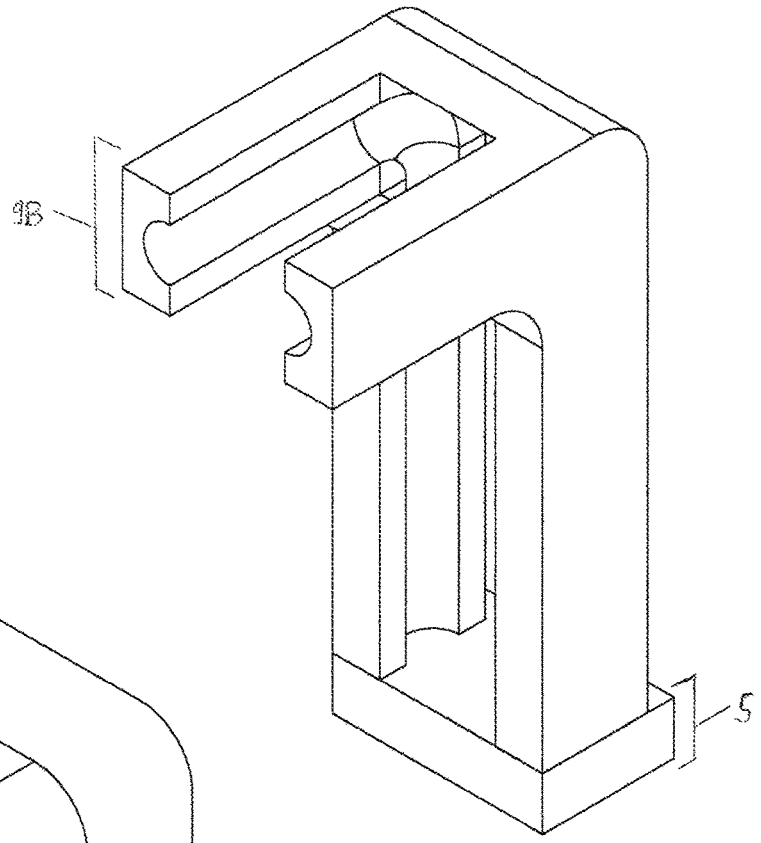
FIG 41
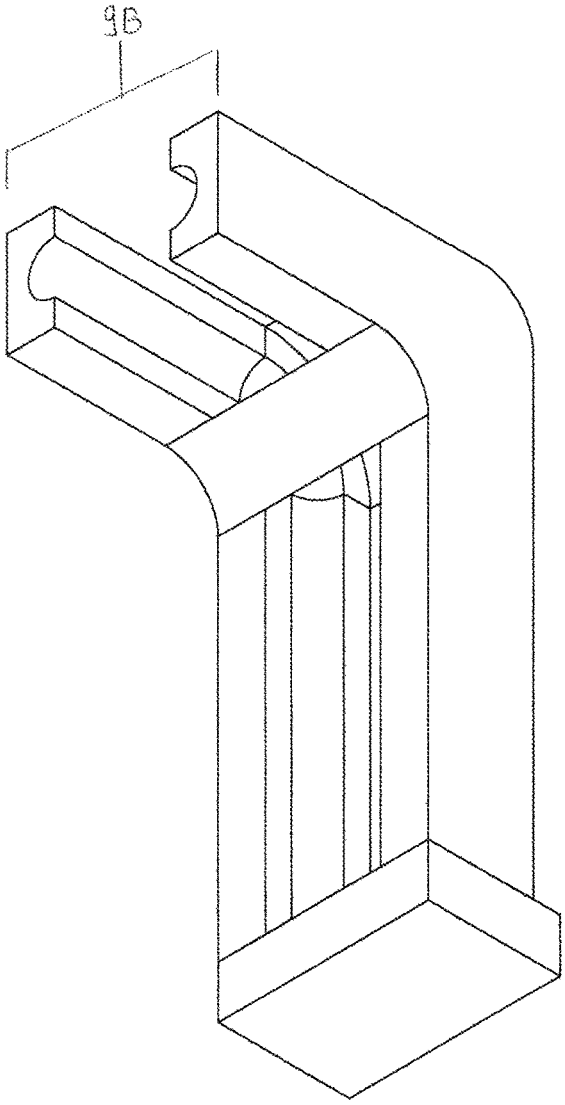
FIG 42
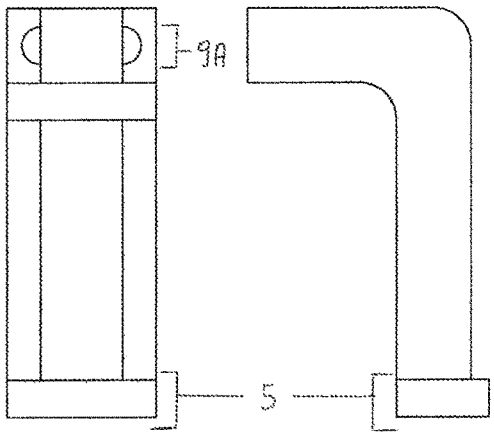
FIG 43
FIG 44

DETAIL A
SCALE 2 : 1

DETAIL A
SCALE 1 : 1

DETAIL C
SCALE 1 : 1

DETAIL B
SCALE 2 : 1

DETAIL D
SCALE 1 : 1

SECTION B-B
SCALE 1 : 1

DETAIL C
SCALE 2 : 1

SELF-CLOSING LID FOR CUP

BACKGROUND-FIELD OF THE INVENTION

The invention is mainly related to day-to-day consumption of beverages food, medication but includes also other products. Containers such as soda, soup, and beer cans (made mostly of metals), containers such as medication, soda, juice, or water in bottles (made primarily in plastic but also in glass, or paper), but also wine in barrels (made in metals or in wood). This is not the complete list of application of the invention but rather some examples.

Background—Prior Art

Spillage of beverages has been an issue that people have had to deal with for a long time. In order to avoid accidental spill and external agent (insects, dust, microbes, and microbes-carriers) to infect one's beverage, containers have lids. In the case of soda and beer cans made out of aluminum and/or other metals, once the container is opened, there is no way close the opening. The consumer must engineer a way to do it. Either by covering the opening with a paper or a piece of cloth, or anything else he/she judges appropriate. Several inventions have been developed to address this issue but with limited success. The present invention has been developed to shift the burden to provide a mean for protection from the consumer to the container itself. The present invention allows the consumer to relax and not to care about his beverage or food getting spilled or spoiled. Through this invention, the container lid will shut itself off as soon as the consumer is done using the container. This to prevent unwanted flows and external agents to alter the consumer experience. This invention allows for the first time to get a food and beverage container lid to be made rapidly, efficiently, and economically, this at the same time as providing a mean to keep the content proper for consumption, and also closing the container automatically as soon as the user is done.

Objects and Advantages

As said earlier, the present invention allows the consumer to relax and not to care about his beverage or food getting spilled or spoiled. Through this invention, the container lid will shut itself off as soon as the consumer is done using the container. Because the invention is concerned with the lid, adopting this new kind of lid will not require manufacturers to completely change their tooling and their machines. The gain made is tremendous for the consumer who does not need to think about protecting his/her beverage anymore.

DRAWING FIGURES

FIG. 1 shows an isometric view of the exploded view and the hidden faces are not shown.

FIG. 2 shows the face view and FIG. 3 shows the profile view of the lid exploded.

FIG. 3 shows the hiddens faces and the spring located inside the box.

FIG. 4 shows the bottom of the lid exploded.

Figure 1:
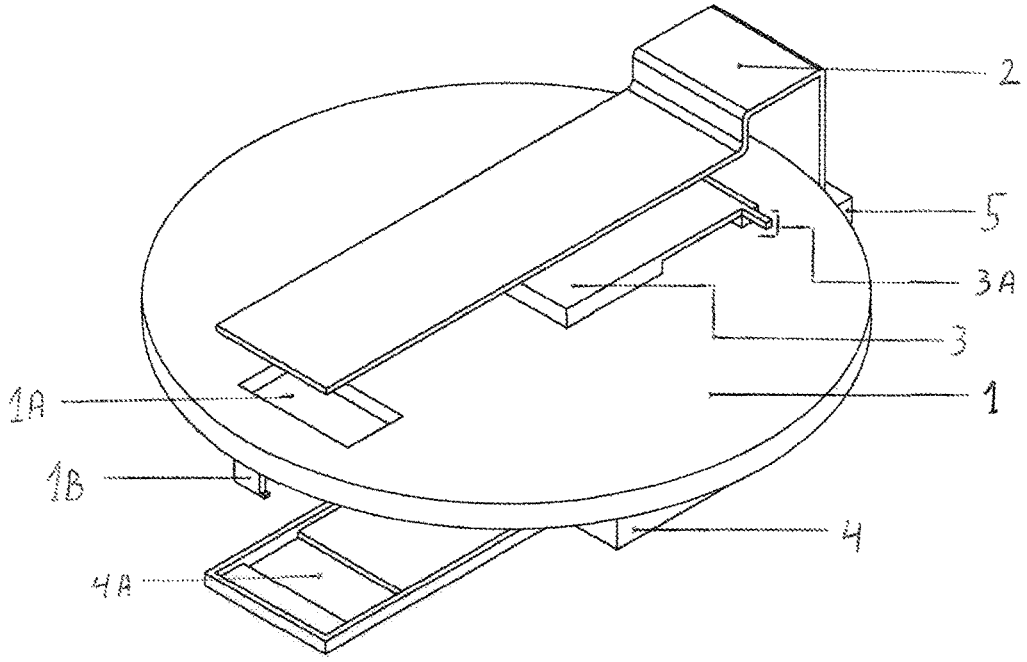
FIG. 1 to FIG. 4 show different views of the lid in exploded view without the removable piece.
Figure 5:
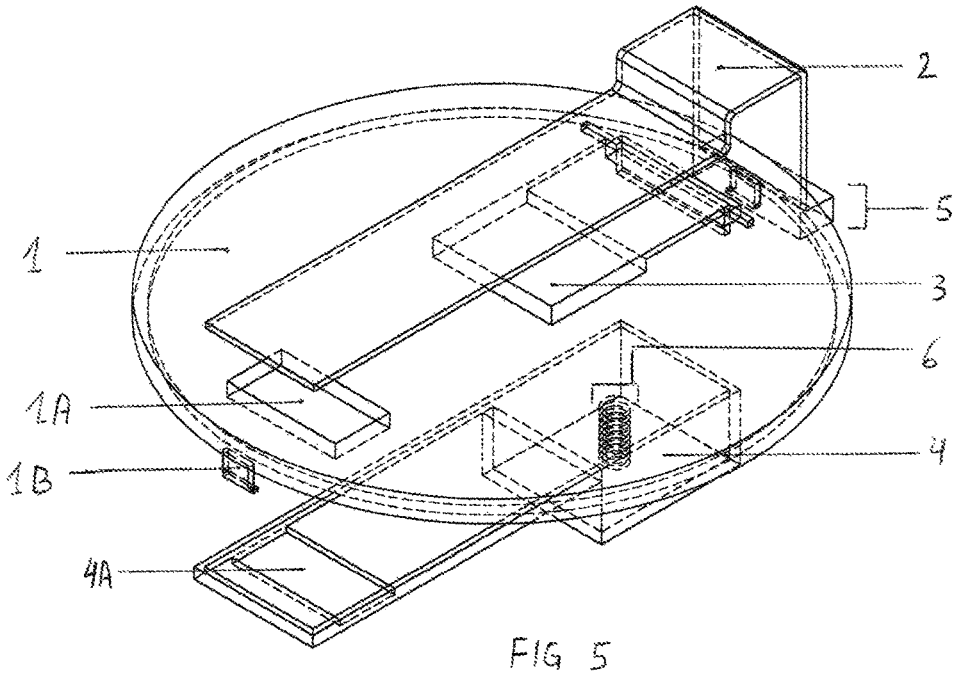
FIG. 5 to FIG. 8 shows the same viewpoints as explained in the previous paragraph.

FIG. 5 corresponds to FIG. 1 except that FIG. 5 shows the hidden faces. The dash lines represent the elements normally invisible from this viewpoint.

Figure 2:
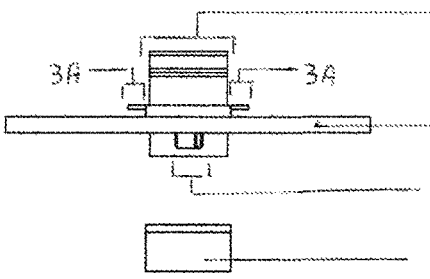
Figure 3:
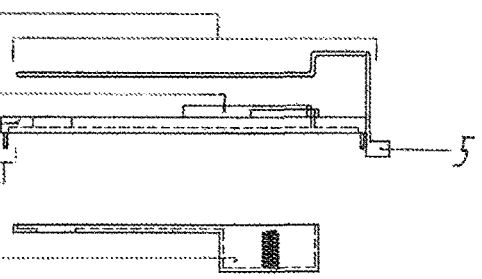
Figure 6:
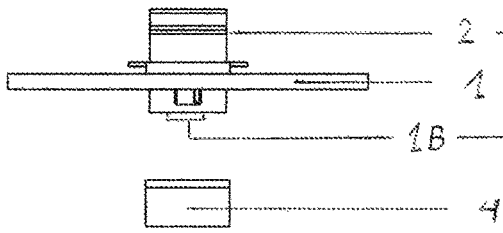
Figure 7:
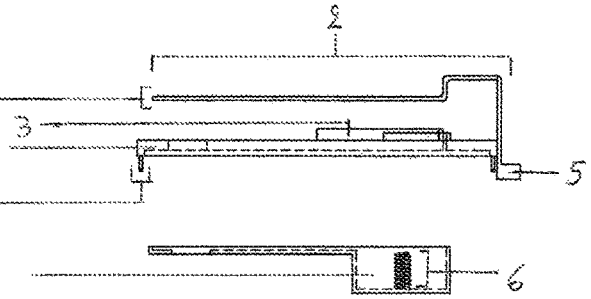

FIG. 6 is the same as FIG. 2,

FIG. 7 matches FIG. 3, and

Figure 4:
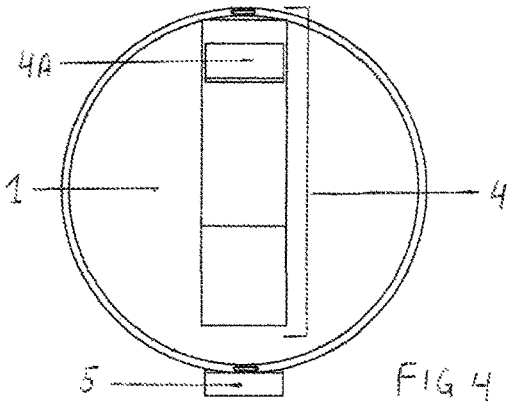
Figure 8:
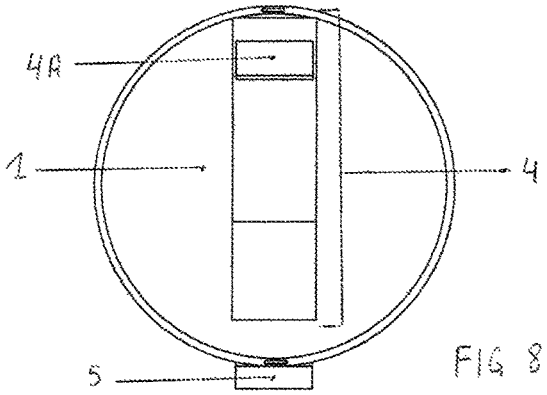

FIG. 8 matches FIG. 4.

FIG. 9 to FIG. 13 show various views of the lid without the moving tongue and the spring and also if the lid does not need to be sealed.

Figure 9:
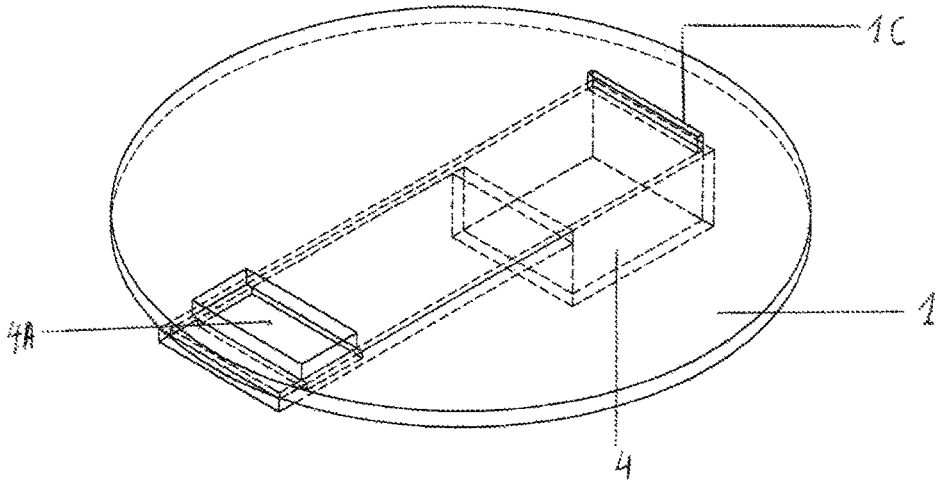

FIG. 9 shows an isometric view of the main cover and the box put together. This view shows the hidden faces, the dash lines represent the elements normally invisible under that view point.

Figure 10:
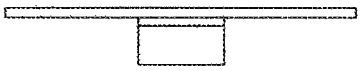

FIG. 10 shows a face view of the two elements while

Figure 11:
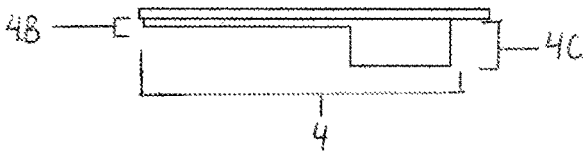

FIG. 11 shows their profile view.

Figure 12:
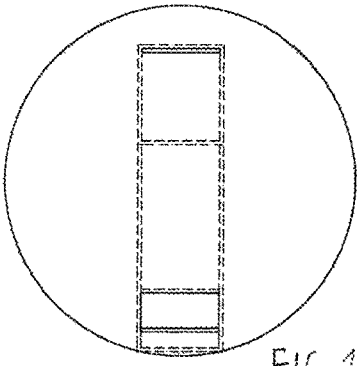

FIG. 12 shows the top view of the main cover and the box put together.

Figure 13:
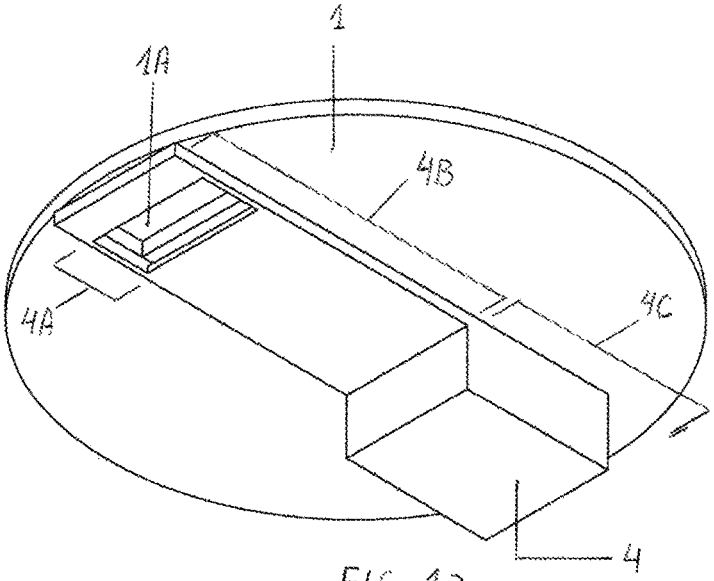

FIG. 13 shows an isometric view of the two elements from the bottom.

FIG. 14 to FIG. 17 show several views of the main cover assuming the lid will not need to be sealed.

Figure 14:
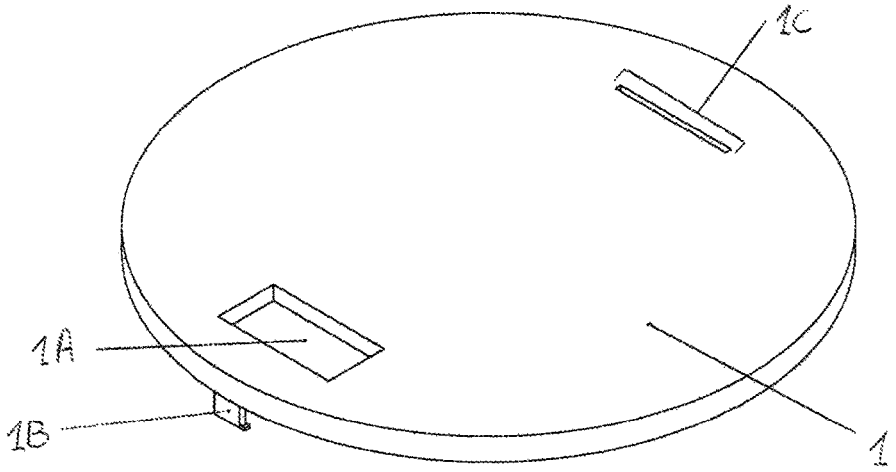

FIG. 14 shows an isometric view of the main cover without the hidden faces.

Figure 15:
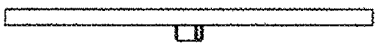
Figure 16:
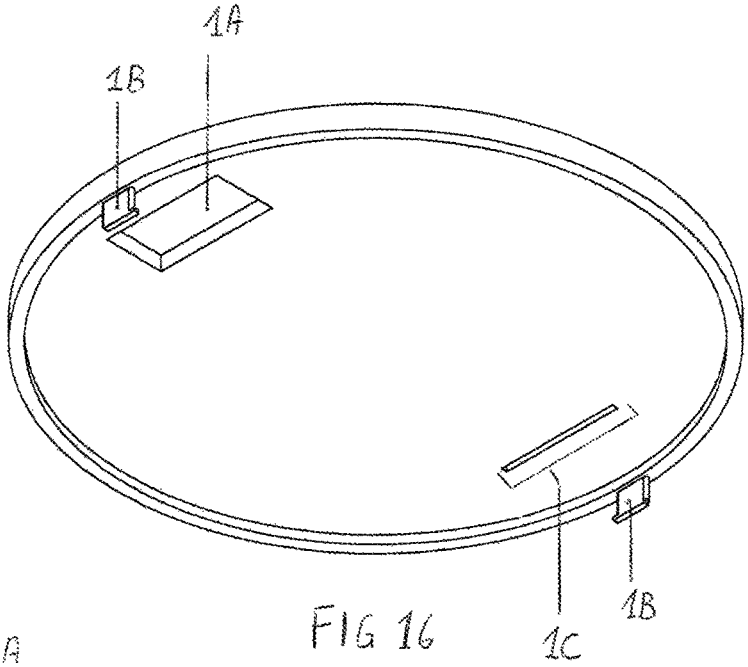

FIG. 15 shows its face view,

FIG. 16 shows an isometric view from the bottom of the main cover, and

Figure 17:
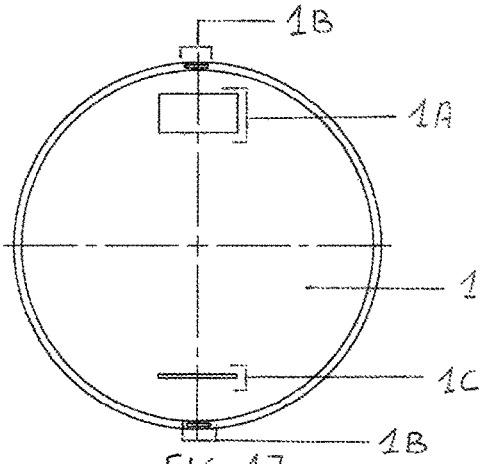

FIG. 17 shows its bottom view.

FIG. 18 to FIG. 21 shows the same view for the same element explained in the previous paragraph.

Figure 18:
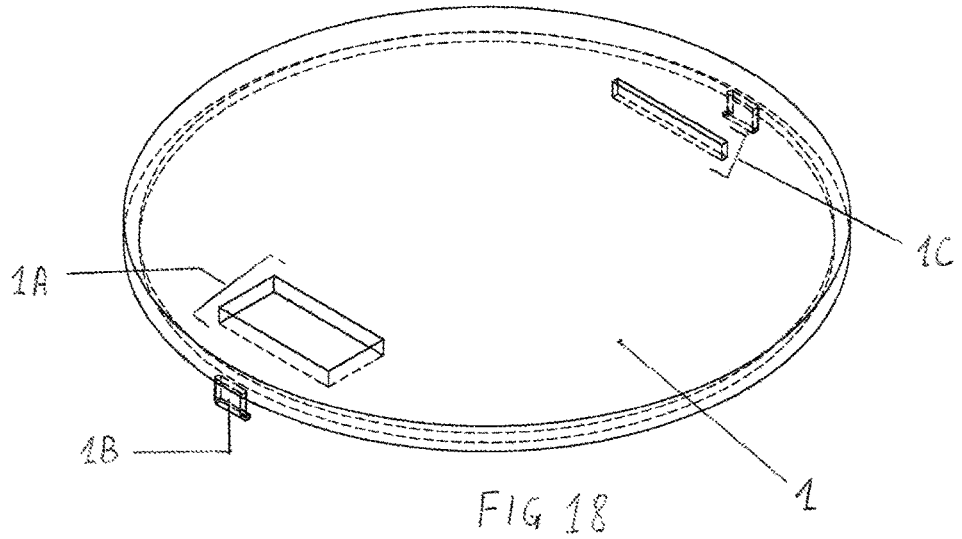

FIG. 18 is the same view as FIG. 14 except that on FIG. 18, the hidden faces are shown. The dash lines represents the elements that would normally be invisible under that view.

Figure 19:
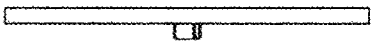
Figure 20:
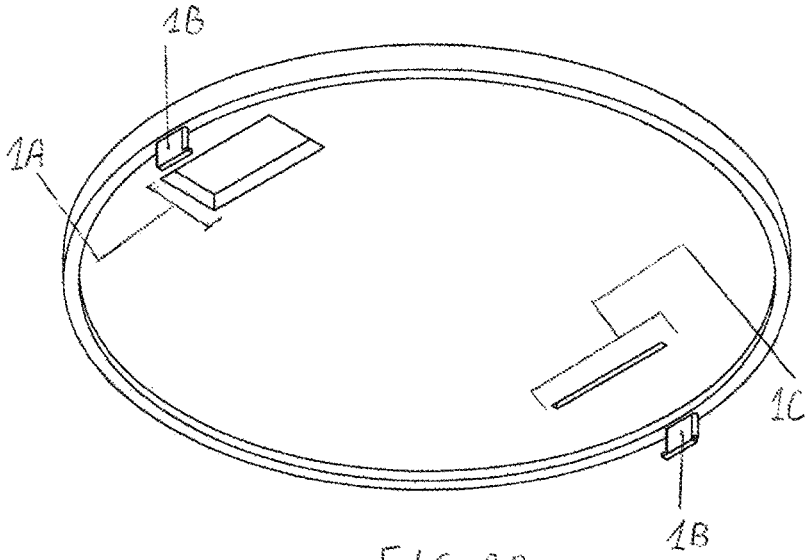

FIG. 19 is the same as FIG. 15,

FIG. 20 is the same as FIG. 16 and

Figure 21:
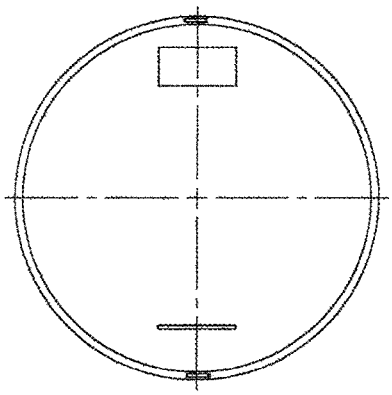

FIG. 21 is the same as FIG. 17.

Figure 22:
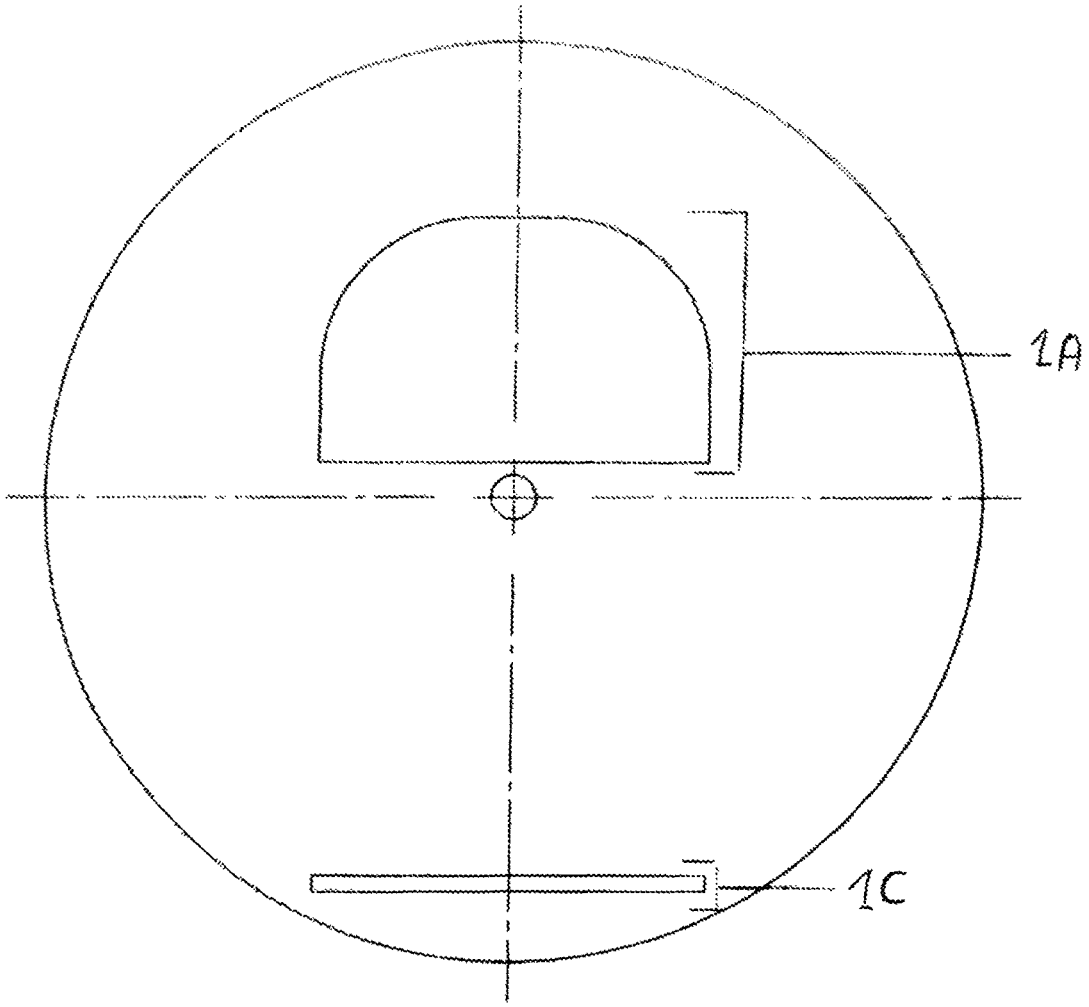

FIG. 22 is a top view of the main cover.

Figure 23:
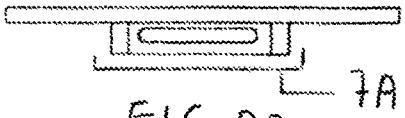
Figure 24:
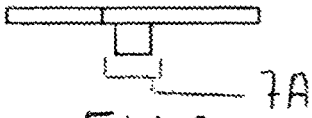
Figure 26:
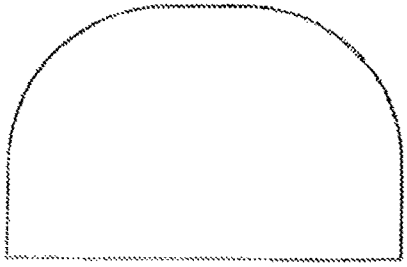

FIG. 23 is a front view of the removable piece,

FIG. 24 is its profile view,

FIG. 26 is its top view, and

Figure 25:
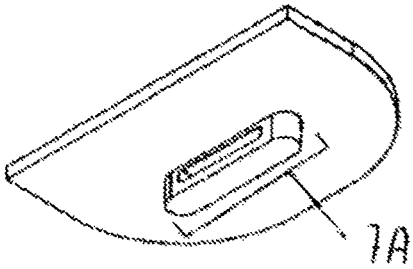

FIG. 25 is its bottom isometric view.

Figure 27:
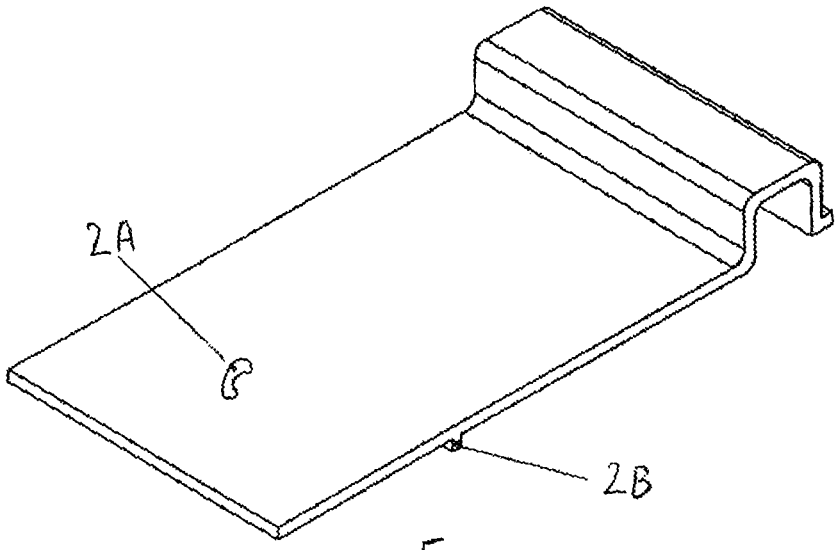

FIG. 27 is an isometric view of the moving tongue featuring the different extrusions that it can accommodate.

Figure 28:
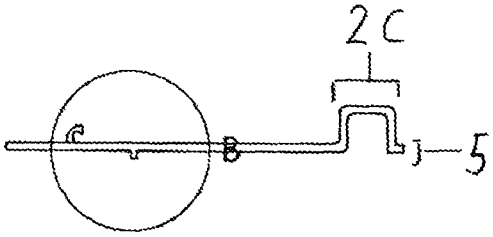

FIG. 28 is its profile view, and

Figure 29:
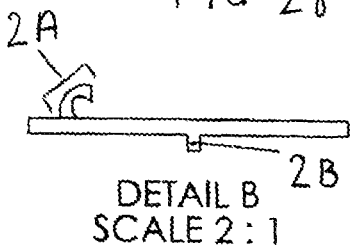

FIG. 29 is a closer profile view of the extrusion on two opposite faces of the moving tongue.

Figure 30:
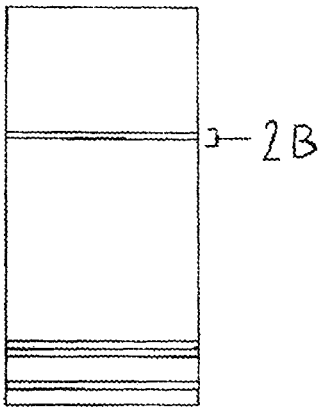

FIG. 30 is its bottom view.

FIG. 31 to FIG. 34 show several views of the box containing the spring.

Figure 31:
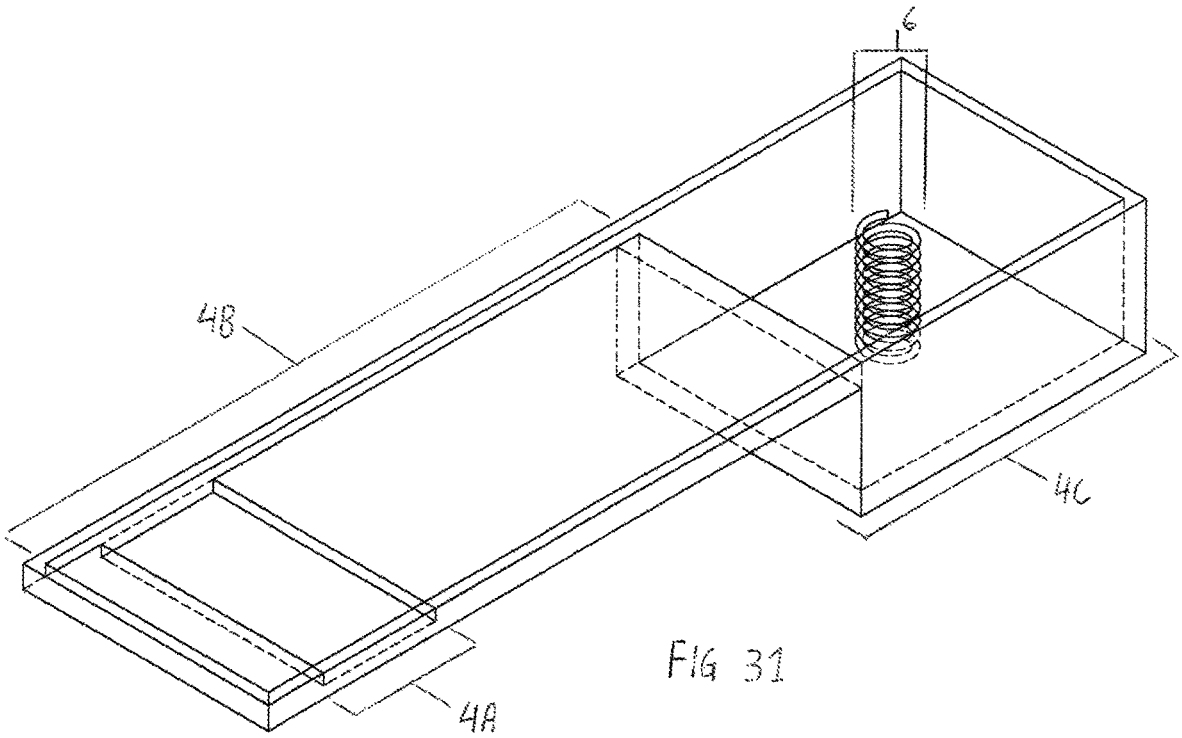

FIG. 31 shows an isometric view of the two elements.

Figure 32:
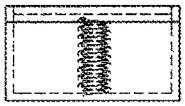

FIG. 32 is a front view and

Figure 33:
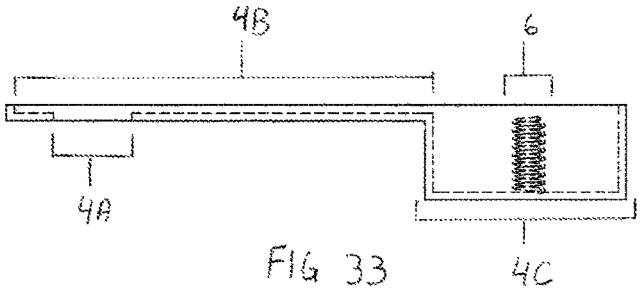
Figure 34:
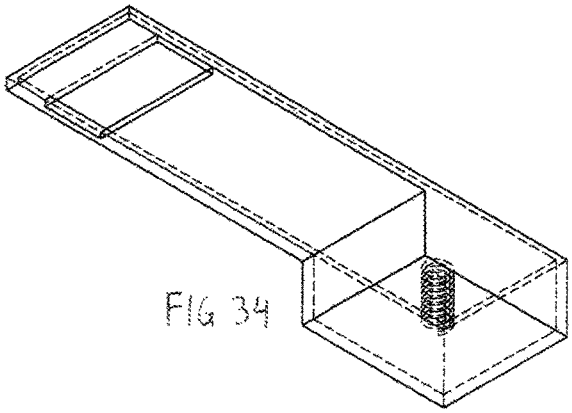

FIG. 34 is an isometric view from the bottom, FIG. 31, FIG. 32, FIG. 33, and FIG. 34 show a view where the invisible faces are shown with discontinuous lines.

FIG. 33 shows a profile view.

FIG. 35 to FIG. 48 show various views of the extensions from the button that help to protect the moving tongue.

FIG. 35, FIG. 36, FIG. 37, FIG. 45, FIG. 46, FIG. 47, and FIG. 48 all show the extensions with their hidden faces presented with discontinuous lines. On the opposite FIG. 38, FIG. 39, FIG. 40, FIG. 41, FIG. 42, FIG. 43, FIG. 44 all show the extensions as a solid body without the hidden faces visible.

FIG. 35, FIG. 36, FIG. 37, FIG. 38, FIG. 39, and FIG. 40 show the extensions without a button attached to it on one side. On the opposite, FIG. 41, FIG. 42, FIG. 43, FIG. 44, FIG. 45, FIG. 46, FIG. 47, and FIG. 48 are images of the extensions featuring the button attached on them.

Figure 35:
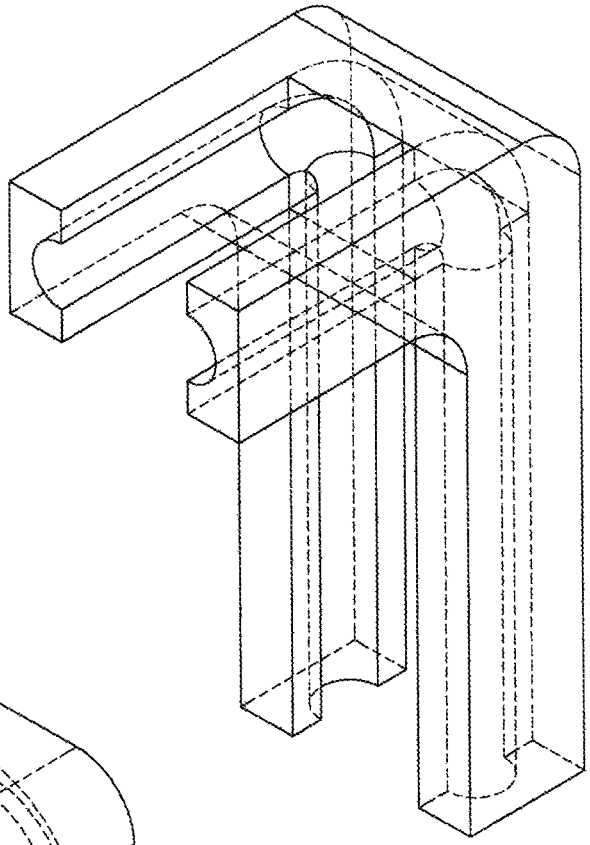

FIG. 35 is an isometric view from the top while

Figure 36:
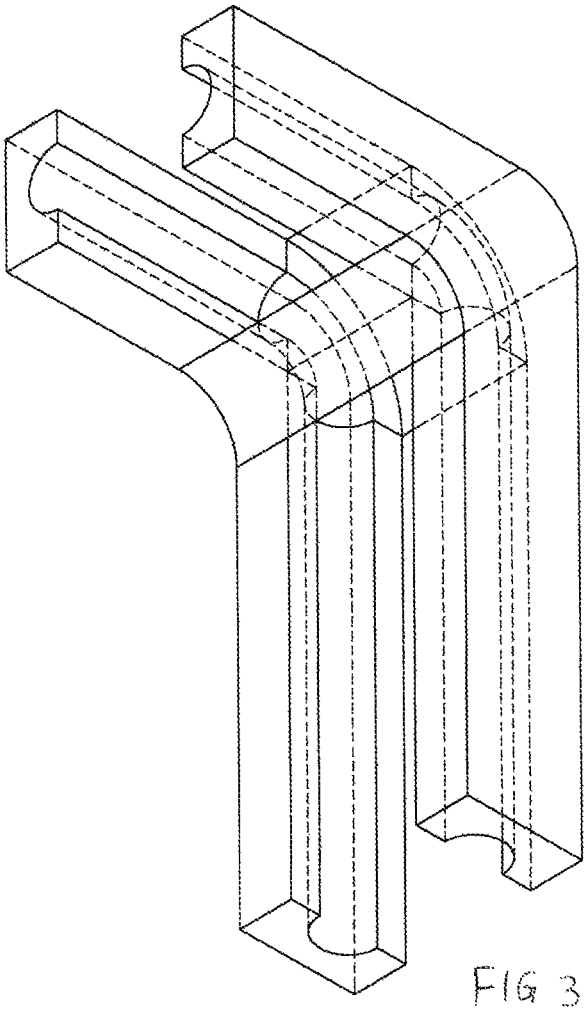
Figure 40:
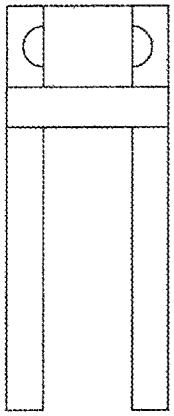
Figure 38:
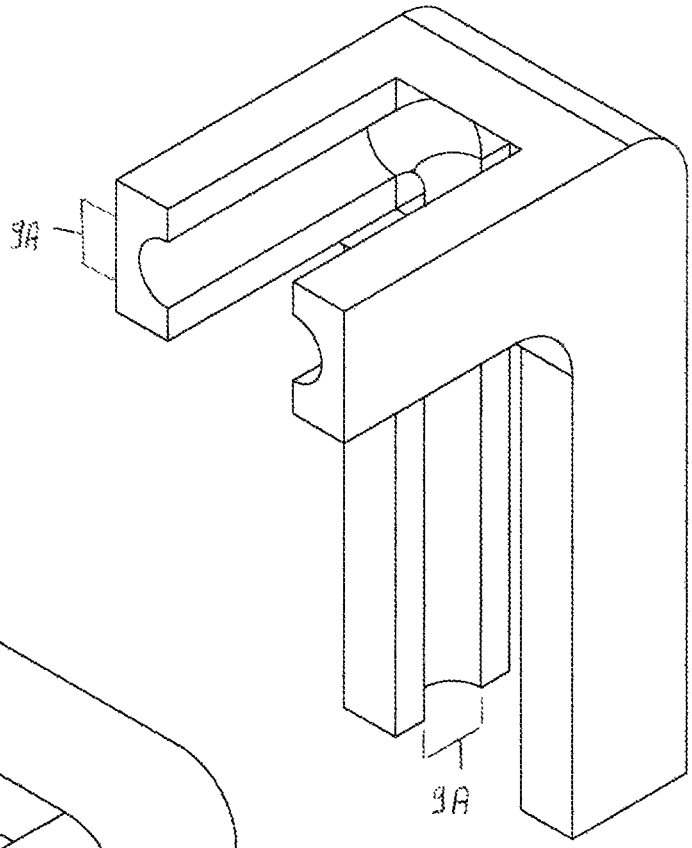
Figure 39:
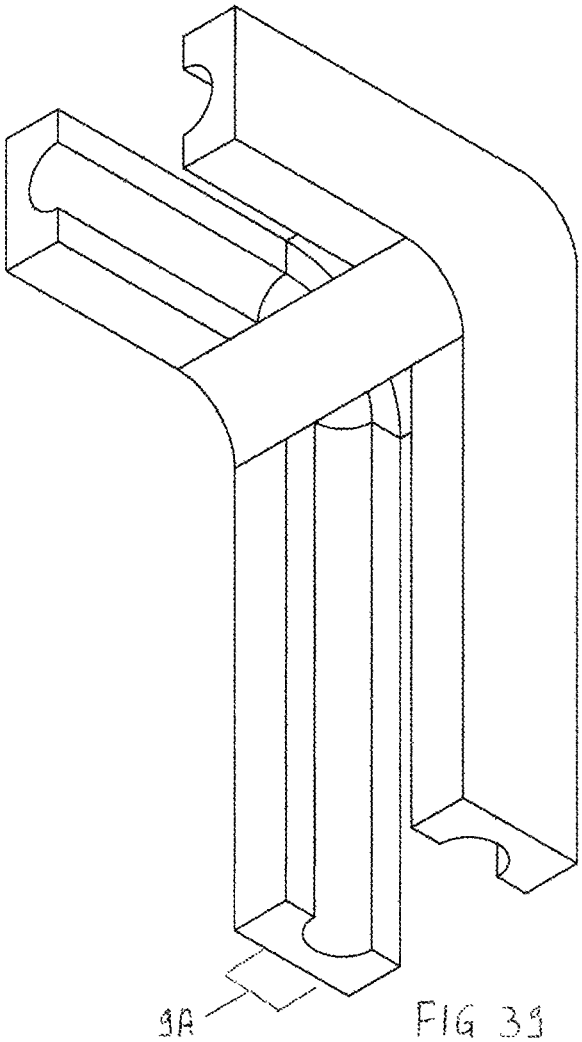
Figure 45:
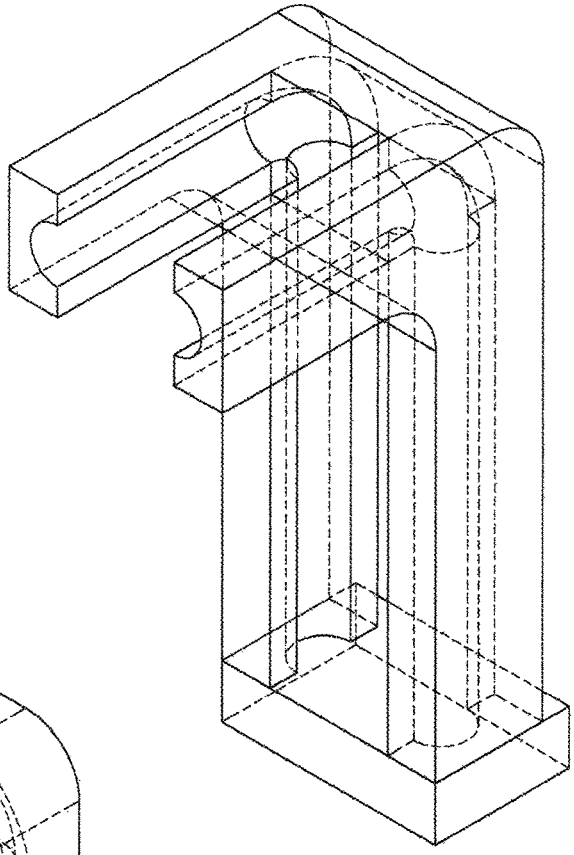
Figure 46:
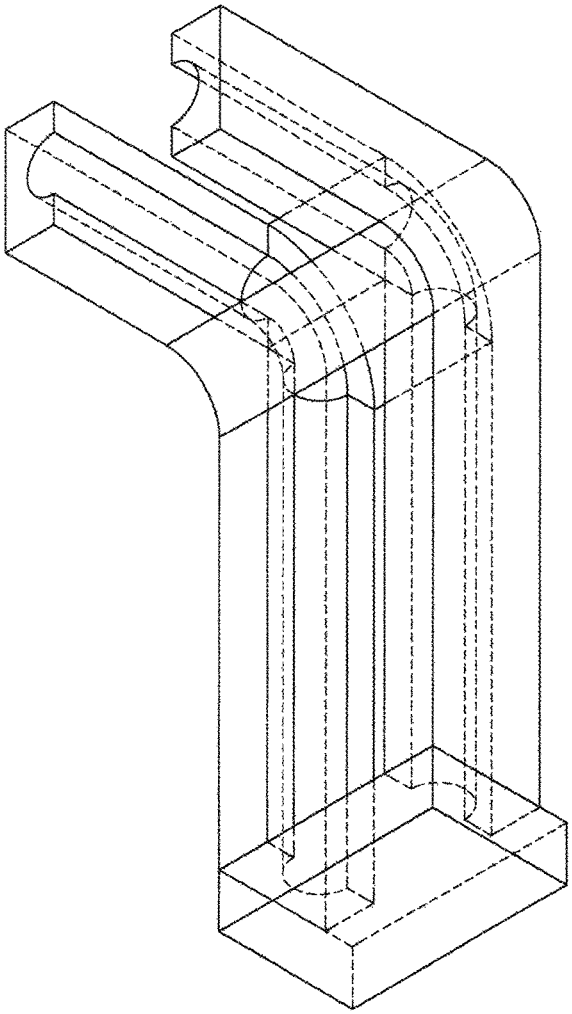
Figure 47:
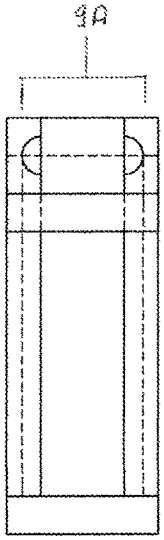
Figure 48:
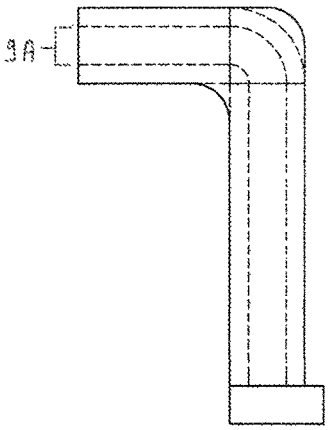

FIG. 36 is the same isometric view from the bottom.

Figure 37:
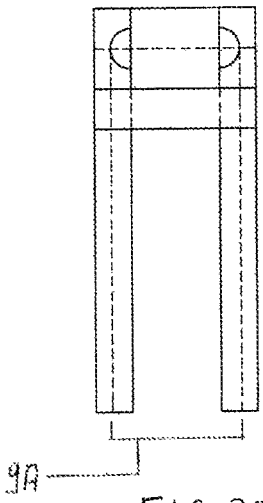

FIG. 37 is a front view of the extensions.

FIG. 49 to FIG. 52 show a type of container featuring the collar that can be used with the extrusions on the lid that are similar to feet.

Figure 49:
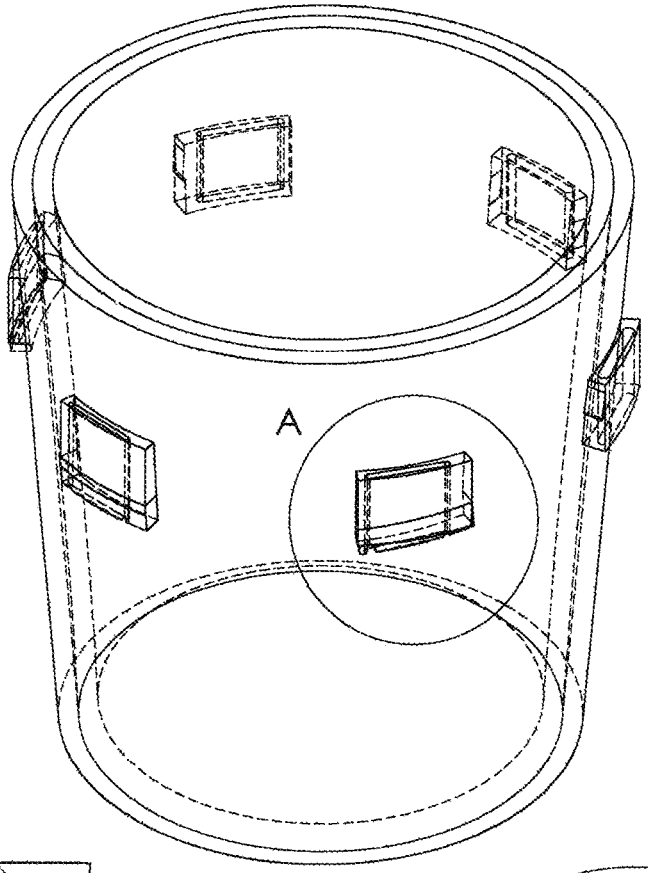

FIG. 49 is view of the container with the hidden faces made visible.

Figure 50:
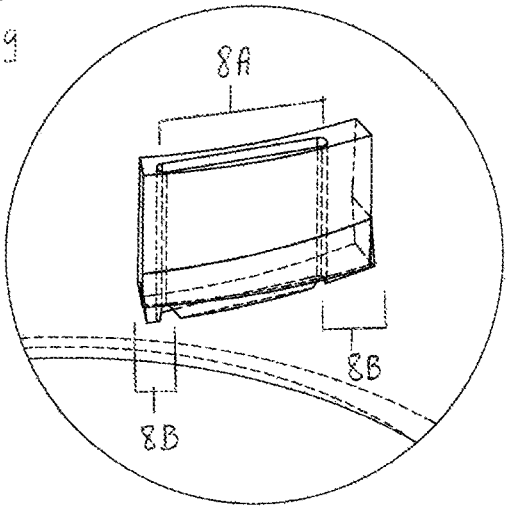

FIG. 50 is a detailed view of one collar with the inside hollow in which the foot goes through end to ends shown in discontinued lines.

Figure 51:
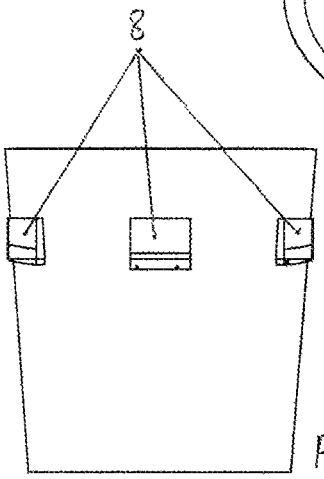

FIG. 51 is a profile view of the container with a series of collar as an example of design.

Figure 52:
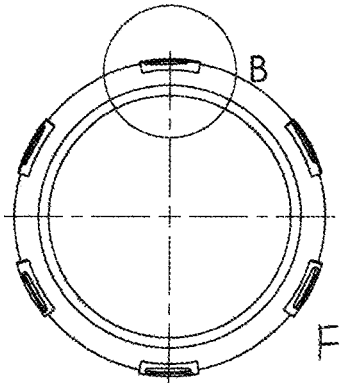

FIG. 52 is a bottom view of the container showing again the collars.

FIG. 53 to FIG. 78 show the other design of the invention.

Figure 53:
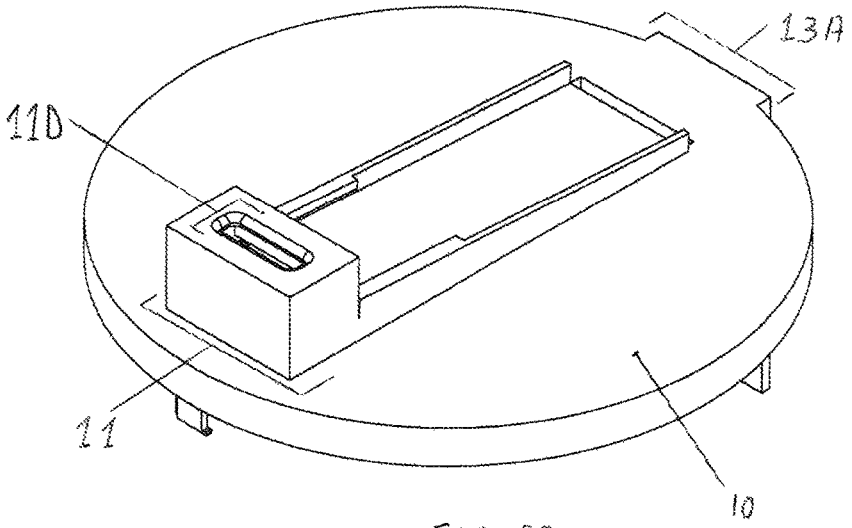

FIG. 53 shows the isometric view of the main cover of the alternative design for the invention.

Figure 54:
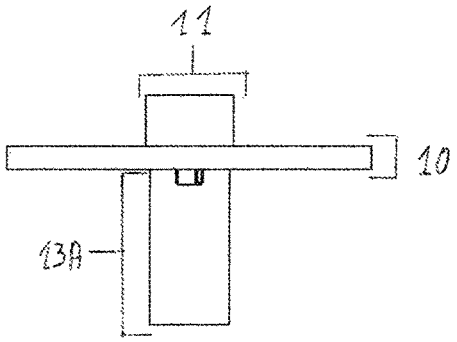
Figure 55:
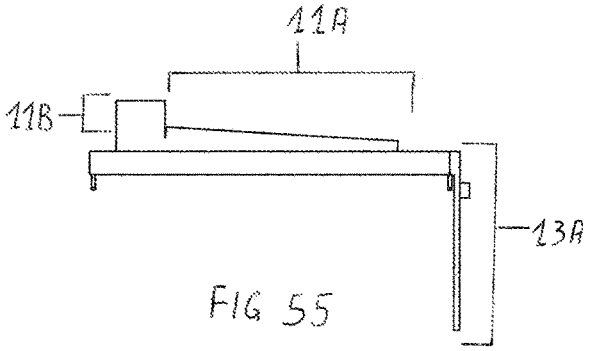
Figure 56:
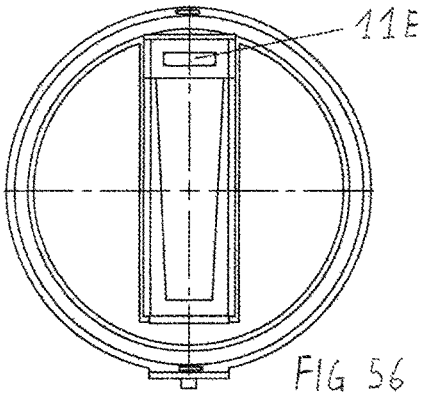

FIG. 54 is a from view of the main cover,

FIG. 55 is its profile view,

FIG. 56 is its bottom view and

Figure 57:
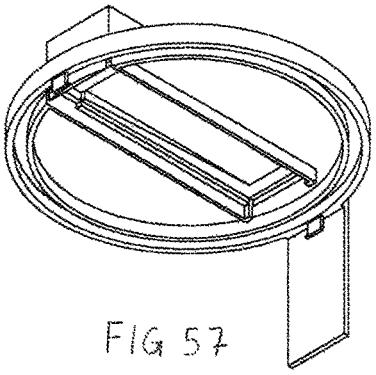

FIG. 57 is its bottom view isometrically. FIG. 53, FIG. 54, FIG. 55, FIG. 56, and FIG. 57 do not show the extrusions that work as grips. They show the extrusions that are inserted into one or a set of collars that are on the container.

FIG. 58 to FIG. 62 shows the same views are the ones explained earlier with the difference that the extrusions that work as a grip on the edge of the cup/container are present instead. Also they represent the main cover with the top surface uncovered in order to show the supports on the walls of the cavity.

Figure 58:
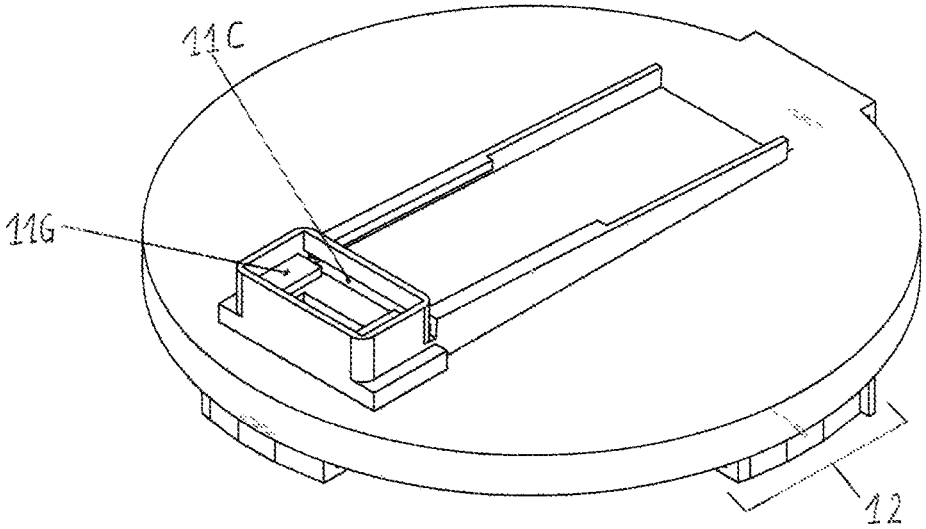
Figure 59:
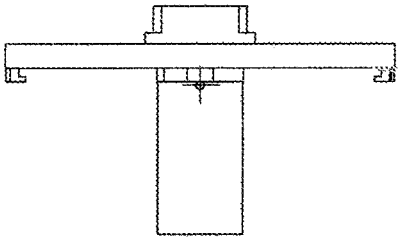
Figure 60:
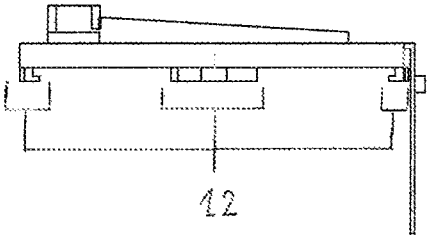
Figure 61:
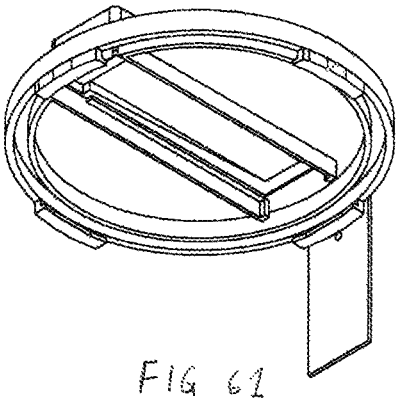

FIG. 58 corresponds to the view of FIG. 53,

FIG. 59 corresponds to the view of FIG. 54,

FIG. 60 corresponds to FIG. 55,

FIG. 61 to FIG. 57, and

Figure 62:
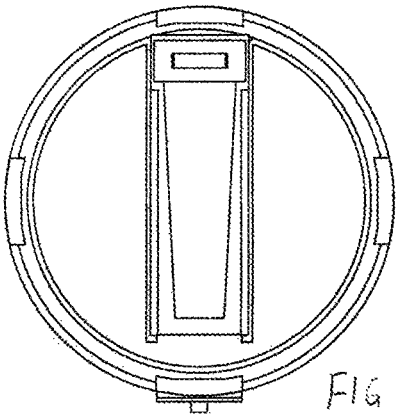

FIG. 62 to FIG. 56.

Figure 63:
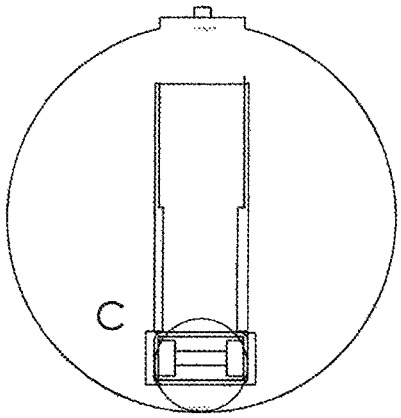
Figure 67:
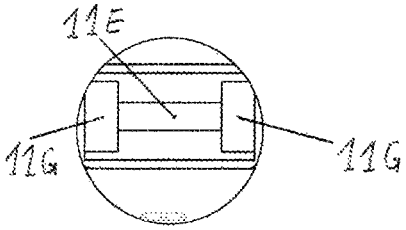

FIG. 63 is the top view of the alternative design of the main cover,

FIG. 67 is a closer look at the interior of the cavity.

Figure 66:
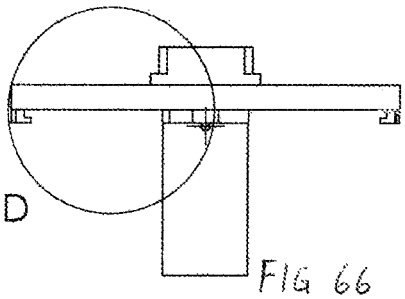

FIG. 66 is a front view of the alternative design of the main cover with

Figure 68:
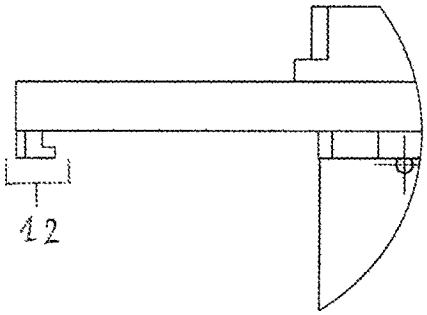

FIG. 68 a closer look at one of the extrusions that acts as a grip to the edge of the container.

Figure 64:
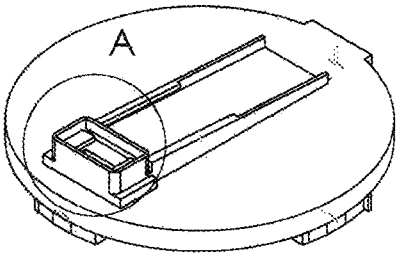

FIG. 64 is similar to FIG. 58.

Figure 65:
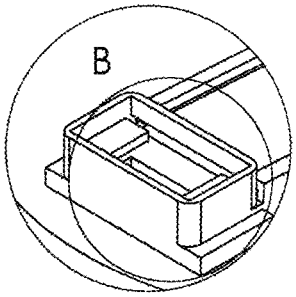
Figure 69:
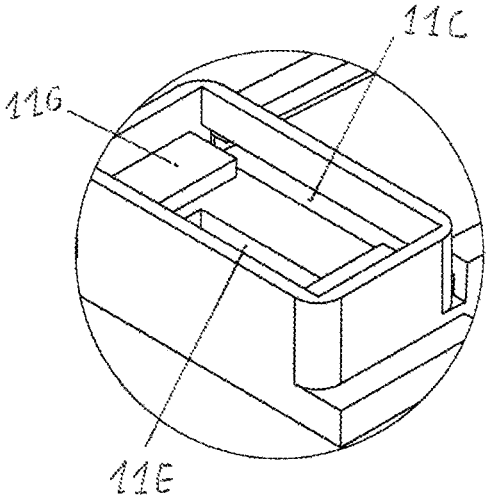

FIG. 65 and FIG. 69 are two closer looks in isometric view of the cavity laid open.

Figure 70:
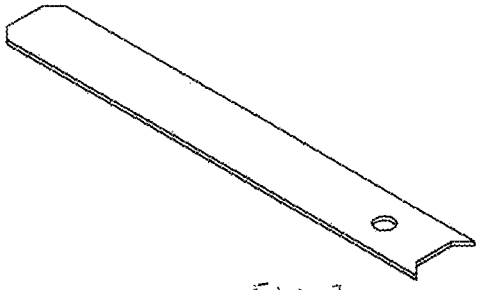
Figure 71:
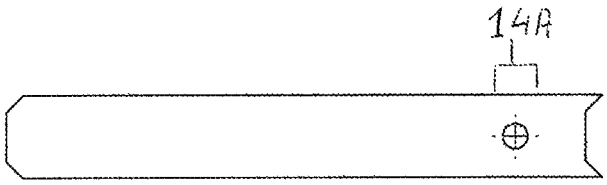

FIG. 70 and FIG. 71 represents two different views of the alternative design for the moving tongue. In this design, the moving tongue features a hole in which the button on the spring can pass through and get both the spring and the moving tongue to be locked together.

FIG. 70 is an isometric view while

FIG. 71 is a top view.

Figure 72:
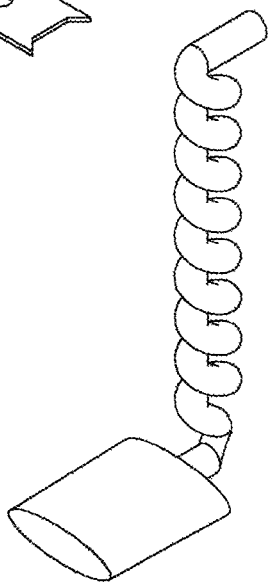
Figure 74:
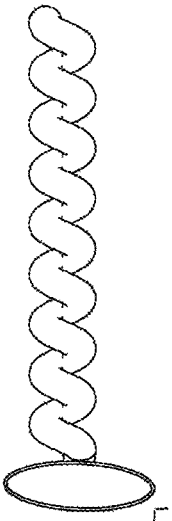
Figure 73:
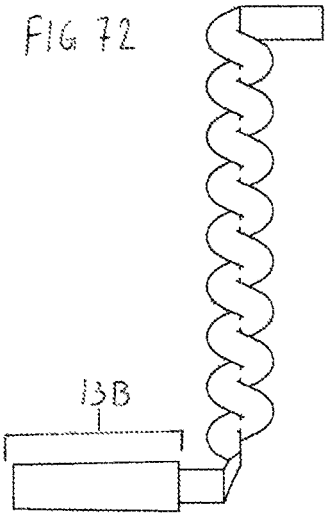

FIG. 72, FIG. 73, and FIG. 74 are three different views of the spring with the button attached to it.

FIG. 72 is an isometric view,

FIG. 73 is a profile view, and

FIG. 74 is a front view.

Figure 75:
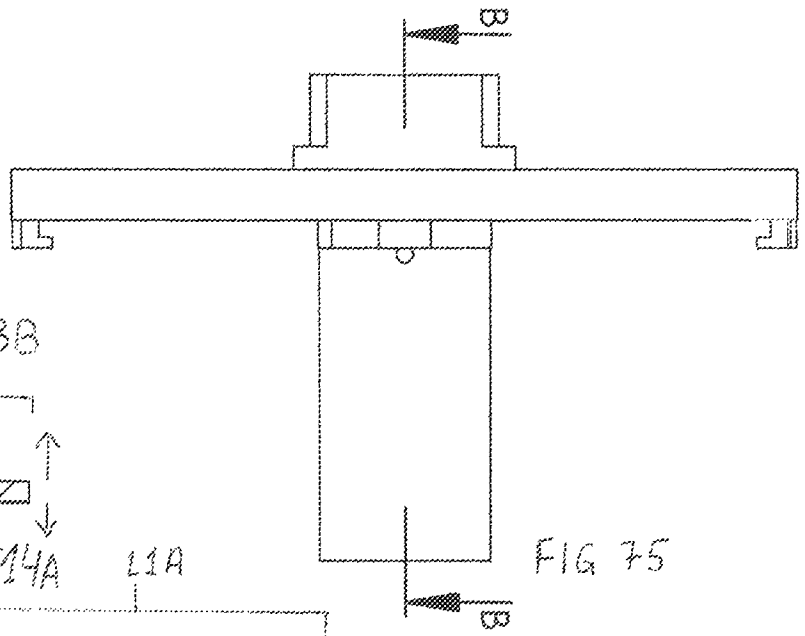

FIG. 75 is a from view of the alternative design of the main cover while

Figure 76:
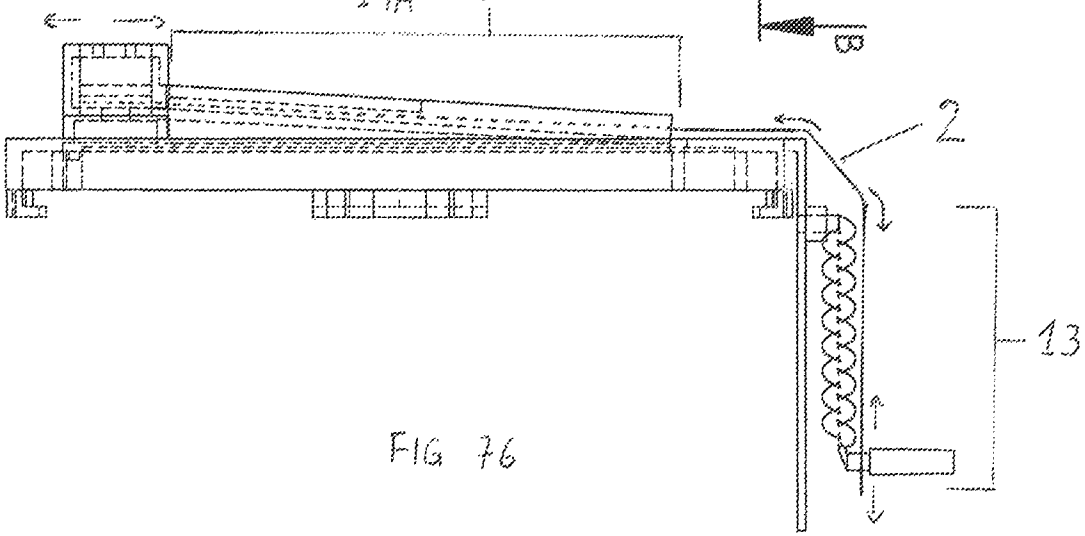

FIG. 76 is a profile view of the same element with the difference that it shows the hidden faces of the main cover in discontinuous lines.

Figure 78:
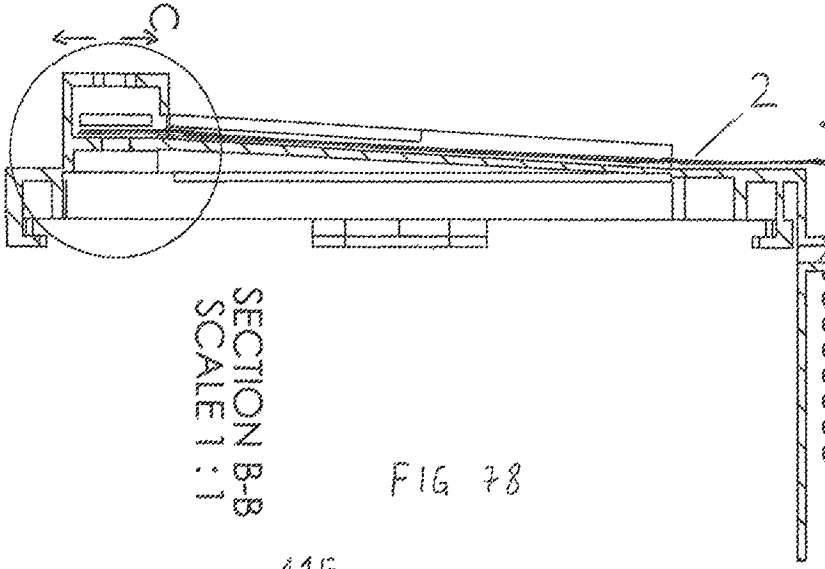

FIG. 78 is a cross section view of the alternative design of the main cover with the spring attached to it.

Figure 77:
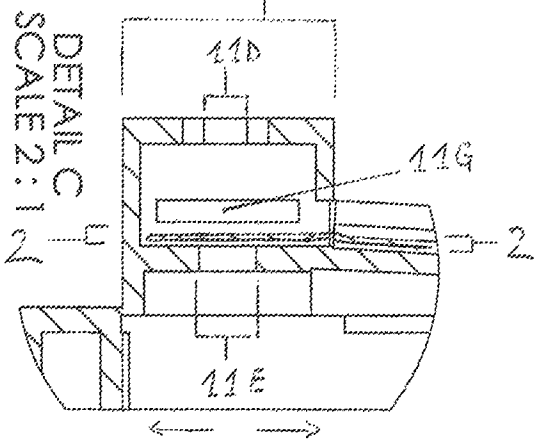

FIG. 77 is a closer look to the cross section of the alternative design of the main cover with an emphasis on the cavity.

LIST OF REFERENCE NUMERALS

1=Main cover; 1A=Open space in which the removable piece is located before opening and provided the lid is supposed to be sealed; 1B=Foot to help for secure closure of the lid on the container; 10=Slit from which the moving tongue emerges out of the interior of the container; 2=Moving tongue; 2A=Extrusion similar to a hook on the moving tongue; 2B=Extrusion similar to a wall on the moving tongue. It is preferable but not mandatory to have a similar but opposite extrusion on either the main cover, the box, or both. The extrusions rub the opposite element when there is a movement occurring.

3=Pull tab; 3A=Extrusion on the pull tab that the consumer can hold onto when he/she wants to separate the pull tab from the moving tongue and the slit;

4=Box or cavity when it is located inside the container (the box or cavity can also be located outside of the container); 4A=Open space of the box from which the content flows out of the container; 4B=Part of the box or cavity on which the moving tongue directly lays; 4C=Part of the box in which the spring is located if the manufacturer needs the spring to be located on the inside (the spring can be located on the outside of the container as well);

5=Button. It can feature any number of extrusions facilitating the grip on the button and its size and shape is at manufacturer's discretion;

6=Spring;

7 =Removable piece; 7A=Extrusion similar to a half or a full ring on the removable piece 8=Collar; 8A=Hollow part in which the foot on the lid is inserted in and out; 8B=Face of the lower end of the collar that touches the lower/horizontal part of the foot when the lid has been turned sideway. This face locks the lid on the container

9=Button Extension—Moving tongue Protection;

10=Second main cover;

11=Extrusion on main cover; 11A=Ramp for moving tongue; 11B=Space for lips to have a grip on the main cover; 11C=Opening for moving tongue or Slit for the moving tongue to enter into the cavity; 11D=Cut or hole connecting the cavity to the exterior, where the consumer will access the content: the content leaves the interior of the cavity towards the consumer; 11E=Cut or hole connecting the interior of the container to the cavity: hole through which the content enters into the cavity/chamber before leaving to the exterior of the container; 11F=Cavity in which the moving tongue is inserted separating the interior of the container to the exterior environment; 11G=Supports on walls of cavity;

12=Extrusion that are used as grips on the edge of the container, similar to the foot presented earlier;

13=Spring and button; 13A=Support for spring; 13B=Extrusion on spring that works as a button directly on spring;

14=Moving tongue with a cut appropriate for the button described as [13B] to pass through; 14A=Cut or hole on moving tongue where the button [13B] passes through and the entire spring and moving tongue are locked together

SUMMARY

The invention presented herein is a lid for container that can be sealed or unsealed, usually plastic and glass bottles, used for carbohydrate and alcoholic beverages and even food. Other kind of containers that can be used with the inventions are metal cans, disposable cups and many others. The list of type of containers that can benefit from this invention is not limited to the few examples cited in this document. The invention is mostly made out of plastic but other materials can be used to get the same result. The main element of the lid is equipped with a pull tab that has attached to it on one side an extrusion from a slit of the main cover and on the other side the pull tab is firmly attached to the main cover. Through a slit cut into the main cover, a slidable, bendable and moving piece of material acting like a tongue will move back and forth as a spring—located below the moving tongue and attached to it, on the inside of the container—is in used or not. The removable piece of the lid can be separated completely from the rest of the lid and will reveal the open space through which the content can flow out of the container. The removable piece should be attached to the moving tongue to avoid it to become a hazard. The spring is located inside a box that has a built-in opening with the same size and same shape as the opening on the outside. Other designs can allow the spring to be located outside of the container but still needs to be connected to the moving tongue. Also, other designs can allow the box to be located outside of the container. In such a case, the box is referred as the cavity that connect the inside and the outside of the container and also is where the moving tongue ends on one side. The user simply has to exert a pressure on the button for the moving tongue to move and reveal the opening of the container in order for its content to flow outside freely.

DESCRIPTION OF INVENTION

The present invention can be used for sealed or unsealed container. In the case of a sealed container, the lid will comprise a main cover(1) featuring a slit(1C) and an open space(1A) having the same size and shape as a removable piece that can be added to the lid according to the need of the manufacturer; located on top of the main cover(1) is attached a pull tab(3) which is attached firmly on one side to the main cover and loosely on the other side to the slit(1C). Other elements include a moving tongue(2) that is connected to a button(5); a spring(6); and a box(4). In the case of an unsealed container, the lid will feature the main cover(1) equipped with a slit(1C) and the open space(1A) but the removable piece is not required alongside the pull tab(3). Still in this case, the lid will feature a moving tongue(2) that is connected to a button(5), and will also have a spring(6) and a box(4).

Main Cover, Foot, and Collar:

The main cover(1) can take any shape suitable with the container. As said it features a slit(1C) and an open space (1A). In the latter is located a removable piece which is attached to the main cover(1) before the first use by the consumer. This occurs if the manufacturer decides to add a removable piece. The removable piece has the same size and the same shape as the open space(4A) of the main cover(1). This is the case because the removable piece must be perfectly sealed unto the main cover(1) at the contour made by the open space(4A). The removable piece features an extrusion(7A) on its lower surface—the one inside the container—that is supposed to be connected to an extrusion (2A) coming from the moving tongue(2). The removable piece can be separated from the main cover(1) by pushing strongly on it with one's finger or anything else judged appropriate by the consumer. The connection between the removable piece and the main cover(1) can be realized the same way as the connection between the bottom ring and the twistable cap that we see in current plastic bottles cap. In this last example, the consumer exerts a rotational force or torque on the twisting cap—the upper and main part of the seal—while the bottom ring does not move. When a certain amount of force has been applied, the twisting cap and the bottom ring separate from each other and on both element appeared small spikes similar to teeth. The same principle of sealing can be applied between the removable piece and the main cover(1). In this case, the force applied should be vertical and the appearance of the small spike similar to teeth should also be present all along the contour of both the removable piece and the main cover(1).

Moving Tongue and Removable Piece:

Assuming the manufacturer wants the lid to be sealed before use by the consumer, he/she will need to add a removable piece at the space(1A) on the main cover(1) where the content of the container is supposed to flow out and the space between the slit(1C) and the moving tongue(2) will also need to be sealed. In the case the container does not need to be sealed, there is no need to add the removable piece to the main cover(1) and the space between the slit(1C) and the moving tongue(2) does not need to be sealed either. In the case the lid needs to be sealed, below the removable piece and attached to it by a set of extrusion, the moving tongue(2) can span all along the main cover(1). It is a flexible, bendable piece of material that is located both inside and outside the container. When it(2) is located inside the container, it(2) is limited on top of it by the lower surface of the main cover(1) and on its bottom and sides by the box(4). The moving tongue(2) emerges out of the container through the slit(1C). The moving tongue(2) can feature one or two walls that help prevent any leaks of the content into the box(4) where the spring(6) is located. One wall can be on the lower face of the moving tongue(2) and faces a side of the box(4) while the other wall can be on the upper face of the moving tongue(2) and faces a wall similar in size emerging out of the lower face of the main cover(1). Assuming the lid has be sealed, right before the first use by the consumer, the moving tongue(2) is sealed on the outside of the lid unto the main cover(1). This is shown as the moving tongue(2) is strongly tight or glued to the main cover(1) where the slit(1C) is located. In order to break the tie between the two elements, the consumer will peel the part of the pull tab(3) that is outside the container off the main cover(1) and will exert a pressure on the removable piece in order to separate this one from the main cover(1). In the case, the container does not need to be sealed off, the pull tab(3) does not need to be added to the main cover(1). The moving tongue(2) never fully leaves the interior of the container because it is connected to the spring(6) on the inside of the container. The spring(6) is attached on one end to the moving tongue(2) and on the other to the box(4). When the open space(4A) of the main cover(1) is blocked or obstructed by the moving tongue(2), the spring(6) is unstretched or at rest. When the open space(4A) is revealed, this means that the spring(6) is stretched out, under stress or extended. It is the case because, the consumer is applying a force on the button(5) located at the outside end of the moving tongue(2). The button(5) is moving, causing the moving tongue(2) to move as well. Thus revealing the opening of the container and allowing the content to flow out. Because the moving tongue is attached to an element: the spring(6) that is fixed on the box(4), this element(6) will be moving as well. However, the element being a spring(6), and it(6) being attached on one end to a fix object: the box(4), the spring(6) will extend or retract in the direction of the movement of the moving tongue(2).

Pull Tab:

In the case the container must be sealed, the pull tab(3) and the removable piece(7) are present. For the same case, in order to open the lid, the consumer will need to exert a pressure on the removable piece(7) until this one separates itself from the main cover(1). The other action from the consumer will be to seize preferably the extremities of the pull tab(3) to peel this one off the main cover(1) where the slit(1C) is located. By peeling at the slit, the connection between the pull tab(3A), the main cover(1), the moving tongue(2), and the slit(1C) itself is broken. The consumer will then need to apply a force on the moving tongue(2) in the direction such that the moving tongue(2) is moving away from the interior of the container. This will rip the rest of the connection between the moving tongue(2) and the slit(1C) until the moving tongue(2) can move freely through the slit.

Foot and Collar:

The edge of the lid can feature one foot or a set of feet(1B) to help for the closure of the container. The feet(1B) can be designed in such a way that they are extrusion from the lower horizontal surface of the edge of the lid. They can be shaped as the letter "L". In the case the feet(1B) are present on the lid, the body of the container, on its wall, should feature as many extrusions similar to collars(8) as the number of feet(1B) present on the lid. The collars(8) are some pieces of material, preferably with a rectangular shape, attached to the wall of the body of the container on their two ends only. This means that except for the two ends of this pieces of material, the rest is not touching the body of the container. This design allows for something to be introduced into that space; the void between the collar(8) and the wall of the container. In order to close the container, the feet(1B), on the lid, will be introduced into the collars(8), on the container. Once the horizontal portion of the foot(1B) has been completely through the collar(8), the consumer can turn the lid in a way that the horizontal portion of the foot(1B) can no longer go through the space of the collar(8) it, the horizontal part of the foot(1B), went through unless the lid is twisted back to the previous position. When the lid is twisted forward for closure, the horizontal part of the foot(1B) is no longer in line with the open space of the collar(8). In this situation, if the lid is pulled away from the body of the container, the lid will not be separated from the body of the container. The horizontal part of the foot(1B) is blocked by the collar.

Another design is available for this invention and pertains mainly but not exclusively to disposable cups used to drink coffee or other beverages. For this other design, the main cover(10) has an extrusion (11) on which the moving tongue(14) lays and also on which the user will apply his/her lips to consume the content of the container. The extrusion (11) works like a ramp(11A) for the moving tongue(14). The user will slide the moving tongue(14) within the enclosed space of the ramp(11A) until the moving tongue(14) enters the cavity(11F) through the slit(11C) located at the upper end of the ramp(11A). That slit(11C) leads to the cavity (11F). This cavity(11F) separates the interior of the container from the exterior. However, the content will be able to flow out from 2 holes. The hole(11E) located at the bottom of the cavity(11F) is connected the interior of the container, while the upper hole(11D) connects the cavity(11F) to the exterior. After the user has inserted the moving tongue(14) into the cavity(11F) through the slit(11C), the moving tongue(14) lays on the floor of the cavity(11F) on top of the bottom hole(11E). As long as the moving tongue(14) occupies that position, the content cannot leave the interior of the container. On the edge and at the bottom of the main cover(10), there can be one or more extrusions or feet(12). Each foot(12) helps the main cover(10) to hold tight on the edge of the container or cup. On the edge of the main cover(10) and on the opposite end to the opening hole(11D), the spring support(13A) will be attached. On the support(13A), the spring(13) is attached on one end. On the other end of the spring, an extrusion that works as a button(13B) is present. The button(13B) is shaped in such a way that it(13B) can penetrate a hole or cut on the moving tongue(14). The cross section of the button(13B) has a shape that matches the hole(14A) on the moving tongue(14) allowing the button (13B) to go through the hole(14A). The moving tongue(14) is a lean piece of material that prevents the content to escape from the container. For that matter, it can be coated with a product that improves insulation and keep it(14) impermeable. On the wall of the cavity(11F), there can be extrusions or supports(11G) aimed at preventing the moving tongue (14) from bending too much under the weight of the content of the container. Such action would likely happen in case of an accident with the container tipped on an non-equilibrium position. The moving tongue(14) when manufactured can be made as a large sheet made of several moving tongues. Each of them(14) can be teared out from the main sheet at the discretion of the user. The large sheet can be roll unto itself for convenience.

Operation of Invention

The lid presented in this document is made to prevent unexpected spillage of beverage and/or food or medication and to close the lid, thus the container also closes automatically. This is possible by attaching or connecting a spring(6) to a moving, slidable and bendable part(2) of the lid which is connected to a button(5) located on the outside for the consumer to use. The moving tongue(2) is partially located inside and partially outside of the container. The container does not need to change its design and method of manufacture because the changes made to the lid are minimal and economical. The lid will keep the same method of opening by the consumer. A method to open the container in a way to benefit from the invention is to push unto the removable piece, in the case the container needs to be sealed before use. The removable piece is pushed unto such that the connection between the removable piece and the main cover(1) is broken. The connection between the removable piece and the main cover(1) can be made with the current technology. Once the connection is broken, the consumer can notice, depending on the method used, a set of extrusions from both the main cover(1) and the removable piece(2) similar to a row of teeth all along the contour of both the removable piece(2) and the main cover(1). These extrusions, the set of teeth, are all along the contour of the removable piece(2) and of the open space(1A) of the main cover(1). It is the same kind of extrusion that are noticeable after twisting the current kind of lid. In this situation, with the current state of the art, the ring that is laying unto the transfer bead of the container is separated from the container cap and it appears on both elements a set of extrusions similar to small teeth. However it is important to note that some method can allow a clear contour without the presence of extrusions. It also depends on the kind of material used to make the elements. After that the consumer will have a simple movement to do unto the button(5) to allow the container to be open and thus allow the content to be poured out of the container. Finally he/she will see it closed automatically as soon as the pressure on the button(5) is stopped. In the case the container needs to be sealed, the removable piece can present an extrusion(7A) on its lower surface. The extrusion(7A) can be similar to a half or a full ring, or any shape that presents an open space surrounded by a thread/body of material with any thickness. The moving tongue(2) needs to have an extrusion(5A) of its own that will make possible the link between the moving tongue(2) and the removable piece. The extrusion(2A) on the moving tongue(2) can be similar to a hook which will get locked into the extrusion(7A) from the removable piece(7) at the opening of the container. The mean of connection can also be similar to a tunnel in which the other extrusion will lock itself in. Inside the space is where the extrusion similar to a hook(2A) from the moving tongue(2) will go through. As the consumer is applying a force on the removable piece, the contour line around the removable piece is revealing the open space(4A). The pressure from the consumer makes the removable piece to go down on the moving tongue(2). As this is happening, the extrusion(2A) similar to a hook gets bent inwardly more and more in a way that the hook-like extrusion(2A) surrounds completely the thread/body of the ring-like extrusion(7A) at a particular region. This will make the removable piece to be hooked and locked to the moving tongue(2) as it is separated from the main cover(1). Other methods of connection between the removable piece and the moving tongue(2) can be used in order to get these two elements to be attached to each other. Such methods includes, but are not limited to, a thread of any convenient material joining the removable piece to the moving tongue(2). As the removable piece is being separated from the main cover(1), it will fall on the moving tongue(2) but will stay connected to it(2) by the thread.

The slit(1C) on the main cover(1) of metal or plastic—or even another kind of material is useableis where the moving tongue(2) goes from inside the container to outside of it. The moving tongue(2) never fully leaves the interior of the container because it is connected to the spring(6), which is connect on the other end to the box(4). The spring(6) brings the moving tongue(2) back to its original position: fully covering the opening(4A) where the content is supposed to be poured out from. In order to seal the lid at the slit(1C), several methods can be used. For example, but this is not the only way, a chemical agent can be applied in the space not occupied by the moving tongue(2) that would seal off completely the slit(1C). Another way could be by creating a chemical change along the edges of the slit(8) in such a way that the slit(1C) will merge with the moving tongue(2). This chemical change can be for example, but not limited to, heating up the edges of the slit(1C) until they can merge with the moving tongue(2). At the region of the slit(1C), the main cover(1) should feature an extrusion( ) that will, before the first use, be attached to the pull tab(3). The pull tab(3) features one or two extrusions(3A) that the user can use to tear the pull tab(3) off the extrusion(1D) from the slit(1C). As said earlier, the slit(1C), the moving tongue(2), and the pull tab(3) are all connected together in a fashion that seals the container at that area.

The moving tongue(2) can be made out of any type of material that is known to be of use in the manufacturing industry, for example aluminum or steel or plastic but any other materials known to work in this situation can be used as well. It is very flexible and can bend easily. It is designed to slide along the wall of the container as shown. It can have various dimensions but should be with respect to the diameter of the lid. Of course, the lid adapts its dimensions with the container. It can feature an extrusion similar to a hook (2A) on its upper side and an extrusion similar to a wall(2B) on the opposite surface but also another extrusion similar to a wall on the same side where the hook-shape extrusion is located. In that case, the main cover(1) should feature a similar extrusion to the wall-shaped extrusion in order for both extrusions to touch each other from top to bottom and to prevent even more any spill of the content into the space between the main cover(1) and the moving tongue(2). The hook-shaped extrusion(2A) is used to attach or connect the moving tongue(2) to the removable piece(7). The latter can also have an extrusion similar to the half of a ring(7A). The hook(2A) is designed in a way that enables its upper end to enter the inner space of the half ring(7A). The hook shape allows it to curve even more inwardly—i.e the upper end moves towards the hook base—when the removable piece (7) is being separated from the rest of the main cover(1) and pushed down on the moving tongue(2). By this method, the removable piece(7) is well locked unto the moving tongue (2) and as the latter is moved back and forth, the consumer does not incur the risk to have the removable piece(7) acting as a hazard. The goal is to avoid the removable piece(7), which must be fully separated from the circular sheet—or main cover(1)—to fall into the content of the container. The mean to connect permanently the removable piece(7) to the moving tongue(2) can be a hook or other kind of connection or attachment able to maintain the two things together. The moving tongue(2) can also feature a wall on either the side of where the hook/attachment(2A) is, or on the opposite side of where it(2A) is, or else two walls can be featured on each superior or inferior side of the moving tongue(2). The wall will help prevent the content to get into the interior of the box(6) where the spring(10) is located. In case the moving tongue(2) has a wall on its superior face, the main cover(1) should feature a wall opposing the one on the moving tongue(2) such that the two walls—on the main cover and on the moving—hit each other from their respective tops and bottoms [Fig.] This means that the top of the wall on the main cover(1) will rug the superior face of the moving tongue(2) and will hit the bottom of the wall coming from the moving tongue(2). And the top of the wall from the moving tongue(2) rugs the inside face of the main cover(1) and hits the bottom of the wall from the main cover(1). These walls can be designed as any type of extrusion coming out from the aforementioned parts. The bottoms of the walls are the parts where we have the connection between the extrusion and the mother element(main cover(1) or moving tongue(2)), the tops are the parts of the extrusions that touch—or rug in case of movement of the moving tongue (2)—continuously the opposite element(main cover or moving tongue) from which the connection is present. [Fig.]

The button(5) is fully located on the outside of the container. It can be attached to one of the end of the moving tongue(2). It can feature one or as many extensions from one of its end. This/these extension(s) can be attached to the outside surface of the main cover(1). They(the extensions) can be designed such that they have a hole/empty space all along their length. By looking at a cross section of one extension, someone can see that it (the extension) is similar to a tunnel or a tube. In the empty space, the moving tongue(2) can be inserted and can move in it back and forth. The extensions are not mandatory but can help prevent the consumer to break the moving tongue(2). The button(5) allows on its surface more space for writing and illustration besides the body of the container (in our case, the body of the can). This space can be used for advertisement. The button(5) is connected to the moving tongue(2) by several means. For example, but these are not the only way to do it: the button(5) can have on one of its sides a hole in which one end of the moving tongue(2) is inserted and locked in; the button can have an extrusion allowing it to get hooked, pinned, screwed in, or attached to one end of the moving tongue(2); the button(5) can have one of its face chemically reacting with one of the end of the moving tongue(2) until the button(5) and the moving tongue(2) are connected together. Such chemical reaction can be for example, but not limited to, heating up the two aforementioned elements to the minimum temperature required to allow the material of both elements to soften itself enough in order to stick the two chemically reacting faces together. Another method to connect the button(5) to the moving tongue(2) is to apply on the surface of both elements a chemical agent that can glue the two element together. This chemical agent can be, but not only, a super adhesive that reacts well with the material used to make the button(5) and the moving tongue(2) in order to see the two elements stick with each other.

Another feature that can be added to the lid is for securing the closure of the container. The edge of the lid can feature one foot or a set of feet(1B) to help for the closure of the container. The feet(1B) can be designed in such a way that they are extrusion from the lower horizontal surface of the edge of the lid. They can be shaped as the letter "L". In the case the feet(1B) are present on the lid, the body of the container, on its wall, should feature as many extrusions similar to collars(8) as the number of feet(1 B) present on the lid. The collars(8) are some pieces of material, preferably with a rectangular shape, attached to the wall of the body of the container on their two ends only. This means that except for the two ends of this pieces of material, the rest is not touching the body of the container. This design allows for something to be introduced into that space; the void between the collar(8) and the wall of the container. In order to close the container, the feet(1B), on the lid, will be introduced into the collars, on the container. Once the horizontal portion of the foot(1B) has been completely through the collar(8), the consumer can turn the lid in a way that the horizontal portion of the foot(1B) can no longer go through the space of the collar(8) it, the horizontal part of the foot(1B), went through unless the lid is twisted back to the previous position. When the lid is twisted forward for closure, the horizontal part of the foot(1B) is no longer in line with the open space of the collar(8). In this situation, if the lid is pulled away from the body of the container, the lid will not be separated from the body of the container. The horizontal part of the foot(1B) is blocked by the collar(8).

For the other design of this invention, the use is more or less similar. In this design, the user simply needs to tear the moving tongue(14) from the larger sheet when he/she needs to. That sheet, as said before can be rolled unto itself for convenience and each unit can be separated from it easily. The main cover(10) is manufactured through various different methods known by any skilled person in the art and should feature all the different extrusions: (11), (12), and (13) by the time the user will add the moving tongue(14) to the main cover(10). Once the user decides to use the product, he/she simply needs to tear the moving tongue(14) out of the main sheet. The moving tongue can feature the trace of separation but everything must fit into the width and length of the ramp(11A). After separating the moving tongue(14), the user will position it(14) on the ramp(11A) and slide it(14) into the space reserved for it(14) on the ramp(11A). The moving tongue(14) will enter into the cavity(11F) by the opening(11C) and will lodge on top of the bottom hole(11E). This position will prevent the content from escaping the container unintentionally. On the other end of the moving tongue(14), where the hole(14A) is located, the user will pass the button(13B) through the hole(14A) until the moving tongue(14) is securely connected to the button(13B), thus the spring(13). After doing this, for operating the product as a whole, the user will need to exert a pressure on the button(13B) which will make the spring(13) to get under pressure and not at rest anymore. As a pressure is being exerted on the spring(13), the moving tongue(14) is being displaced from its original position: covering the floor and bottom hole(11E) of the cavity(11F). As the moving tongue (14) is being displaced and the inside opening is being revealed, the content is now free to flow out of the container. It will pass through the bottom hole(11E), get into the cavity(11F) and leave the cavity(11F) through the upper hole(11D). As soon as the user decides to stop exerting a pressure on the button(13B), the spring(13) will go back instantly to its initial position at rest. This action will cause the moving tongue(14) to move back over the bottom hole, fully reclosing the entire container. Another feature of the main cover(10) is the foot or series of feet(12) that help secure the main cover(10) more tightly on the edge of the container.

The invention claimed is:

1. A lid assembly for enclosing and protecting content of a container that is used to consume beverages or food by an individual comprising;

a lid with a planar surface on its exterior side featuring an opening that allows the content to escape the container; a moving tongue;

an upper protrusion on said planar surface of said lid that increases in height gradually along a diameter of said planar surface and said upper protrusion features a delimited space for said moving tongue to be placed upon the said upper protrusion in such a manner that it is possible to slide said moving tongue seamlessly along said upper protrusion and keep said moving tongue within the delimited space;

a spout located at an uppermost end of said planar surface of said upper protrusion defining an inner space and having an upper hole, a bottom hole configured to communicate with a container, and a slot adjacent said planar surface communicating with said inner space;

said moving tongue being configured to slide along said planar surface and into said inner space through said slot to cover said bottom hole;

a lateral protrusion on a lateral edge of said lid adjacent a lowermost end of said planar surface;

a spring connected to said lateral protrusion at a first end and having a button extending laterally from a second end, said spring configured to extend vertically when pressure is applied to said button;

wherein said moving tongue is securely connected to said button such that when said pressure is applied to said button the moving tongue is displaced from covering said bottom hole to allow content to flow out of the container through said upper hole.

* * * * *